US012274337B2

(12) United States Patent
Xu

(10) Patent No.: US 12,274,337 B2
(45) Date of Patent: Apr. 15, 2025

(54) PEN HOLDER

(71) Applicant: Liang Xu, Suzhou (CN)

(72) Inventor: Liang Xu, Suzhou (CN)

( * ) Notice: Subject to any disclaimer, the term of this patent is extended or adjusted under 35 U.S.C. 154(b) by 0 days.

(21) Appl. No.: 18/890,151

(22) Filed: Sep. 19, 2024

(65) Prior Publication Data

US 2025/0009096 A1 Jan. 9, 2025

(51) Int. Cl.
*A45C 11/34* (2006.01)
*A45C 13/02* (2006.01)

(52) U.S. Cl.
CPC ..... *A45C 11/34* (2013.01); *A45C 13/02* (2013.01)

(58) Field of Classification Search
CPC ..... A45C 11/34
USPC ..... 206/214, 371
See application file for complete search history.

(56) References Cited

U.S. PATENT DOCUMENTS 4,501,358 A * 2/1985 Zinbarg ..... B43M 99/003 206/214
4,700,829 A * 10/1987 Goodyear ..... B43M 99/008 211/11
4,972,947 A * 11/1990 McCarthy ..... B43M 99/006 206/214
5,009,336 A * 4/1991 Liaw ..... B43M 99/008 206/214
5,480,037 A * 1/1996 Pope ..... B42D 5/006 206/215
6,189,711 B1 * 2/2001 Chang ..... B43M 99/00 211/11
6,296,127 B1 * 10/2001 Tseng ..... B42F 17/28 211/47
6,457,593 B1 * 10/2002 Hsu ..... A47F 5/02 211/163
6,735,825 B1 * 5/2004 Berman ..... B43K 23/001 24/3.13
6,974,026 B2 * 12/2005 Chan ..... A45C 11/34 206/214
7,980,387 B2 * 7/2011 Allen ..... B43M 99/008 206/214
2005/0074269 A1 4/2005 Asselin
2006/0186068 A1 * 8/2006 Bewsky ..... B43M 99/006 211/69.1
2006/0261017 A1 * 11/2006 Yoon ..... B43M 99/007 211/69.1
2009/0261006 A1 10/2009 Sweet
2011/0094983 A1 * 4/2011 Burnside-Hall ..... B43M 99/001 211/164
2015/0328918 A1 11/2015 Cho et al.

* cited by examiner

*Primary Examiner* — Jacob K Ackun
(74) *Attorney, Agent, or Firm* — Jeenam Park

(57) ABSTRACT

The present disclosure discloses a novel pen holder, including a pen holder base and a pen holder frame; the pen holder base is configured to place the pen holder; the pen holder frame is arranged on the pen holder base; the pen holder frame can rotate on the pen holder base; the pen holder frame is provided with an accommodating chamber, and the accommodating chamber is configured to accommodate pens or other office supplies. Through the above structural arrangement, during use, the pen holder can be placed on an office desk through the pen holder base, and the pens or other office supplies are placed in the accommodating chamber of the pen holder frame.

16 Claims, 14 Drawing Sheets

PEN HOLDER

TECHNICAL FIELD

The present disclosure relates to the field of office supplies, and in particular, to a novel pen holder.

BACKGROUND

In daily office work, various types of pens are often used, such as pencils, ballpoint pens, signature pens, fountain pens, and marker pens. Furthermore, various office supplies such as paper clips and erasers will also be used. For the above-mentioned office supplies, users usually use a pen holder for storage. In the prior art, the pen holder is usually placed on an office desk. Most pen holders are one-piece. Generally, the pen holder is configured with an accommodating chamber to accommodate the office supplies. Due to the wide variety of office supplies used in daily life and a generally fixed position of the pen holder, it is not convenient for users to search for, take out, and place the office supplies at different positions in the accommodating chamber.

SUMMARY

To overcome the shortcomings in the prior art, the present disclosure provides a novel pen holder.

The technical solution used in the present disclosure to solve the technical problems is as follows:

The present disclosure provides a novel pen holder, including a pen holder base and a pen holder frame; the pen holder base is configured to place the pen holder; the pen holder frame is arranged on the pen holder base; the pen holder frame can rotate on the pen holder base; the pen holder frame is provided with an accommodating chamber; and the accommodating chamber is configured to accommodate pens or other office supplies.

A resistance reducing device is arranged between the pen holder frame and the pen holder base to reduce friction resistance during rotation of the pen holder frame.

The resistance reducing device includes balls; the balls are arranged at a top of the pen holder base; and the balls resist against a bottom of the pen holder frame to form a supporting point for the bottom of the pen holder frame.

The resistance reducing device further includes a bracket; the bracket is arranged at the top of the pen holder base; and the balls are arranged on the bracket.

A ball chamber is arranged on the bracket; a width dimension of the ball chamber is slightly greater than a diameter of each ball; a height dimension of the ball chamber is slightly less than the diameter of the ball; the ball chamber has a top opening; and when the ball is arranged in the ball chamber, the ball resists against the bottom of the pen holder frame through the top opening.

A width dimension of the top opening is slightly less than the diameter of the ball to limit the ball in the ball chamber.

A bracket groove is provided at the top of the pen holder base; the bracket is arranged in the bracket groove; and a height of a side wall of the bracket groove is less than the diameter of the ball, so that the ball protrudes out of the bracket groove and resists against the bottom of the pen holder frame.

The bracket is arranged in a circular ring shape; correspondingly, the bracket groove is arranged in a circular ring shape too; the ball chamber is provided with a bottom opening; and the ball resists against a bottom wall of the bracket groove via the bottom opening, so that the bracket can rotate in the bracket groove.

A width dimension of the bottom opening is slightly less than the diameter of the ball to limit the ball in the ball chamber.

The ball chamber is a spherical inner chamber, and a diameter of the ball chamber is slightly greater than the diameter of the ball.

A circumferential center of the bracket is coaxial with a rotation center of the pen holder frame; at least three ball chambers are arranged in a circumferential direction of the bracket; and the balls are arranged in the at least three of the ball chambers.

Eight ball chambers are provided; and the eight ball chambers are uniformly distributed in the circumferential direction of the bracket.

A rotating shaft is arranged at a position, provided with the rotation center, at the bottom of the pen holder frame; correspondingly, a center hole is provided at the top of the pen holder base; and the rotating shaft is arranged in the center hole, so that the pen holder frame can rotate on the pen holder base.

A limiting slot is provided on an outer wall of the rotating shaft in the circumferential direction of the rotating shaft; a limiting block is arranged at a top port of the center hole; and when the rotating shaft is arranged in the center hole, the limiting block is arranged in the limiting slot.

At least two limiting blocks are arranged around the top port of the center hole; and a gap is provided between every two adjacent limiting blocks to achieve intermittent arrangement between every two adjacent limiting blocks.

Four limiting blocks are provided.

The accommodating chamber includes a center chamber arranged in a center and a surrounding chamber arranged around the center chamber.

The surrounding chamber is uniformly divided into four surrounding sub-chambers along the circumferential direction.

A side wall of the center chamber is higher than a side wall of the surrounding chamber.

The present disclosure further provides a novel pen holder, including a pen holder base and a pen holder frame; the pen holder base is configured to place the pen holder; the pen holder frame is arranged on the pen holder base; the pen holder frame rotates on the pen holder base; the pen holder frame is provided with an accommodating chamber; the accommodating chamber is configured to accommodate pens or other office supplies;

the novel pen holder further includes a circular-ring-shaped rotating bracket and a circular-ring-shaped guide rail; the rotation bracket is arranged at a top of the pen holder base or a bottom of the pen holder frame; correspondingly, the guide rail is arranged at the bottom of the pen holder frame or the top of the pen holder base; the rotation bracket is arranged into the guide rail; and the rotation bracket can rotate in the guide rail, so that the pen holder frame can rotate on the pen holder base.

The present disclosure has the beneficial effects: Through the above structural arrangement, during use, the pen holder can be placed on an office desk through the pen holder base, and the pens or other office supplies are placed in the accommodating chamber of the pen holder frame. The pen holder has a simple structure and is convenient to use. Since the pen holder frame can rotate on the pen holder base, when an office supply is searched for, taken out, or placed, a user can rotate the pen holder frame to make different positions in the accommodating chamber close to the user, and the user can quickly find a desired position in the accommodating chamber, which achieves convenient and efficient searching for, taking out, and placement of the office supply.

BRIEF DESCRIPTION OF THE DRAWINGS

For clearer descriptions of the technical solutions according to the embodiments of the present disclosure, the drawings required to be used in the description of the embodiments are briefly introduced below. The drawings in the description below are only some embodiments of the present disclosure, and those skilled in the art that other drawings can be acquired according to the drawings without creative efforts.

The present disclosure will be further explained below in conjunction with the accompanying drawings and embodiments.

DETAILED DESCRIPTION OF THE EMBODIMENTS

Figure 1:
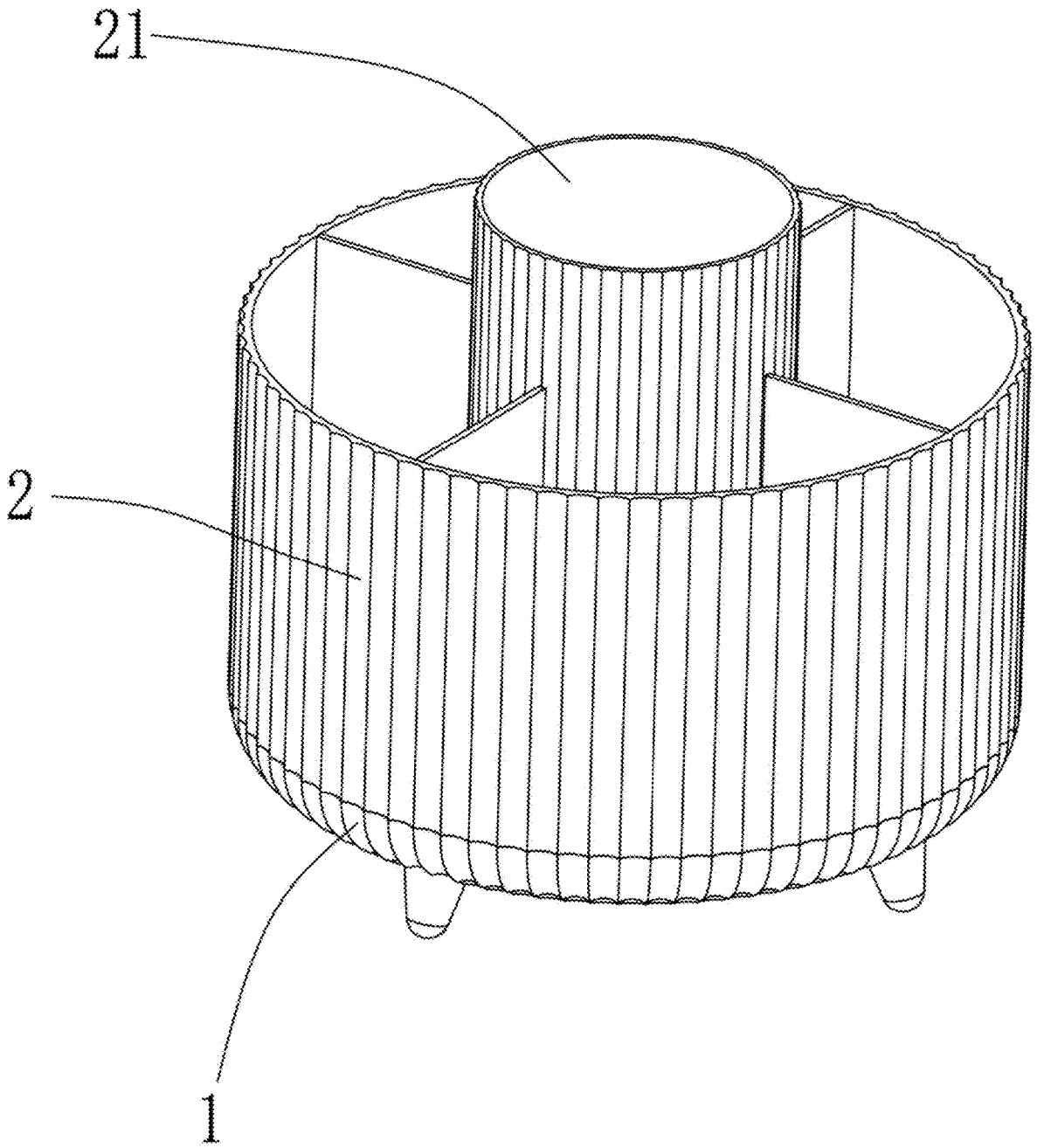
FIG. 1 is a schematic structural diagram of the present disclosure, showing a top of a pen holder.
Figure 2:
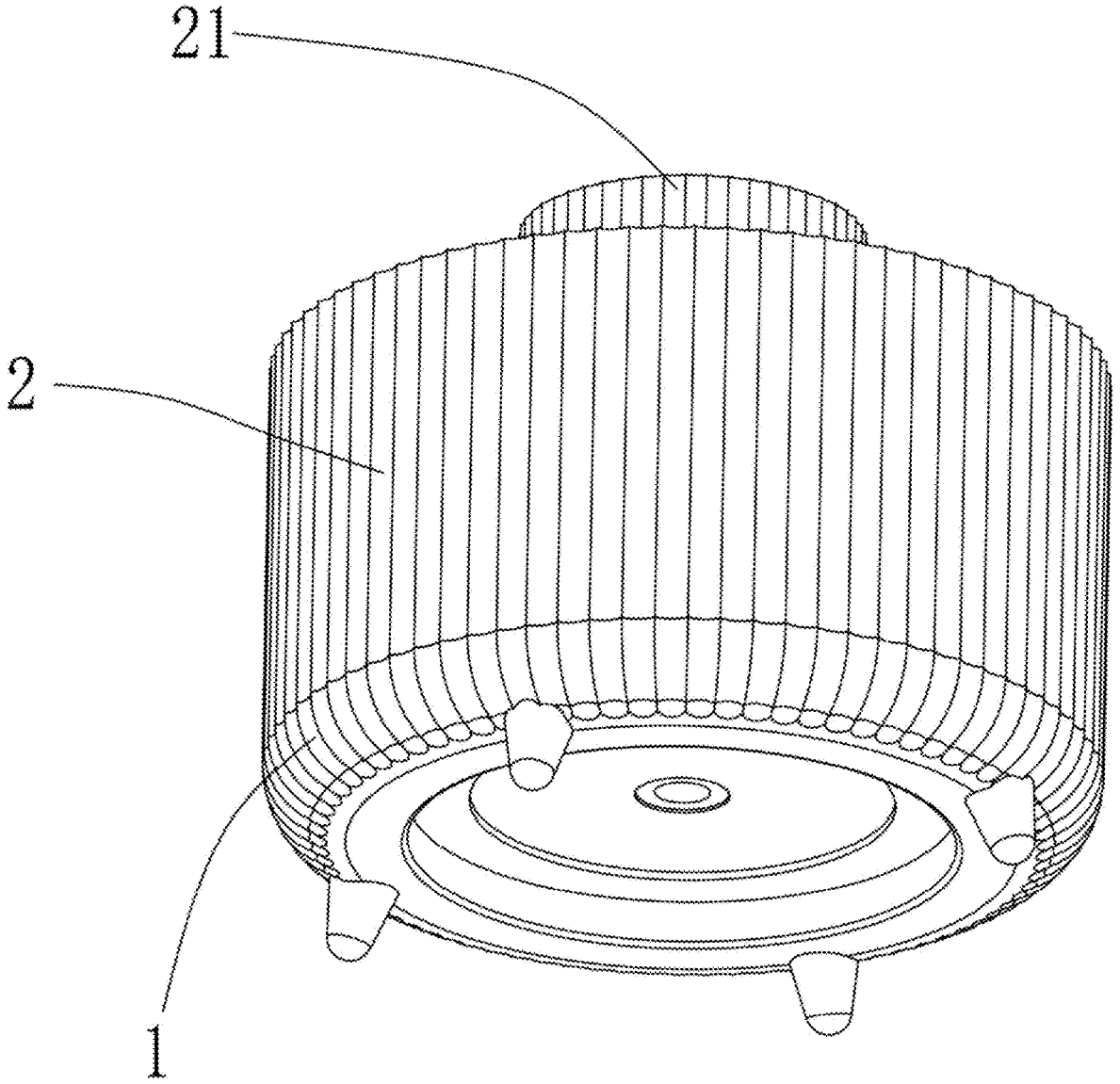
FIG. 2 is a schematic structural diagram of the present disclosure, showing a bottom of a pen holder.
Figure 3:
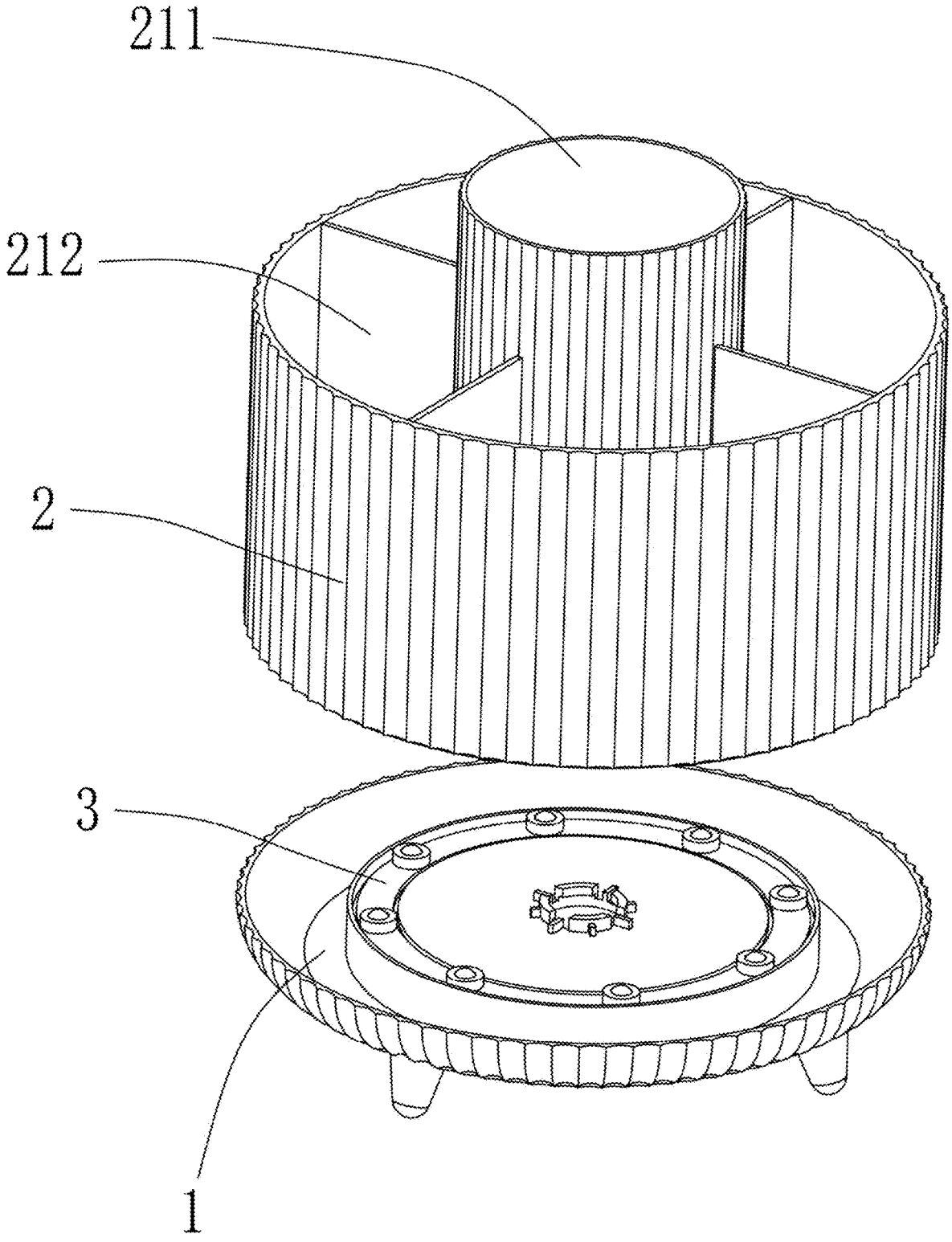
FIG. 3 is a schematic exploded diagram of FIG. 1, where a pen holder frame is exploded.
Figure 4:
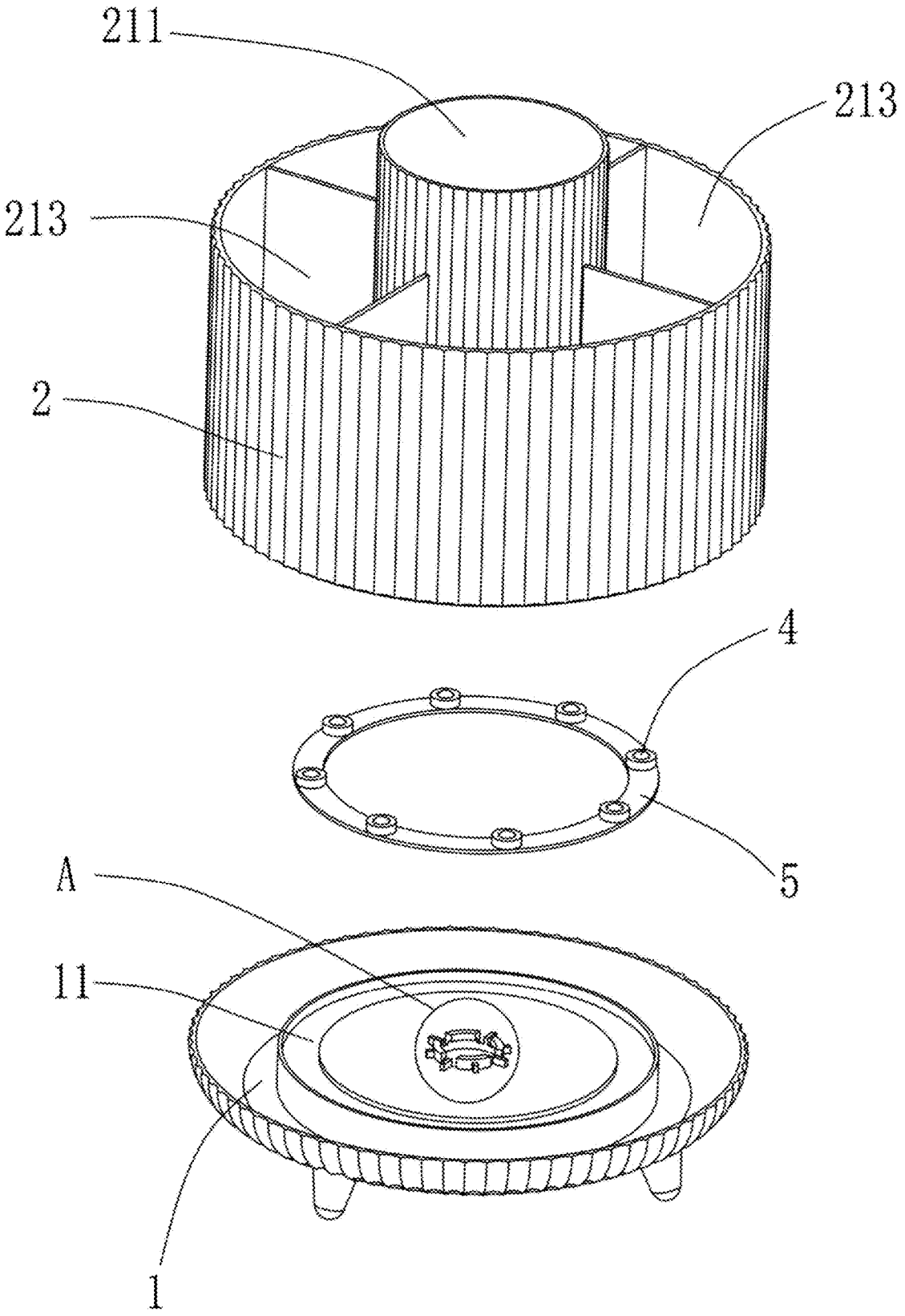
FIG. 4 is a schematic exploded diagram of FIG. 1, where a pen holder frame and a resistance reducing device are exploded.
Figure 5:
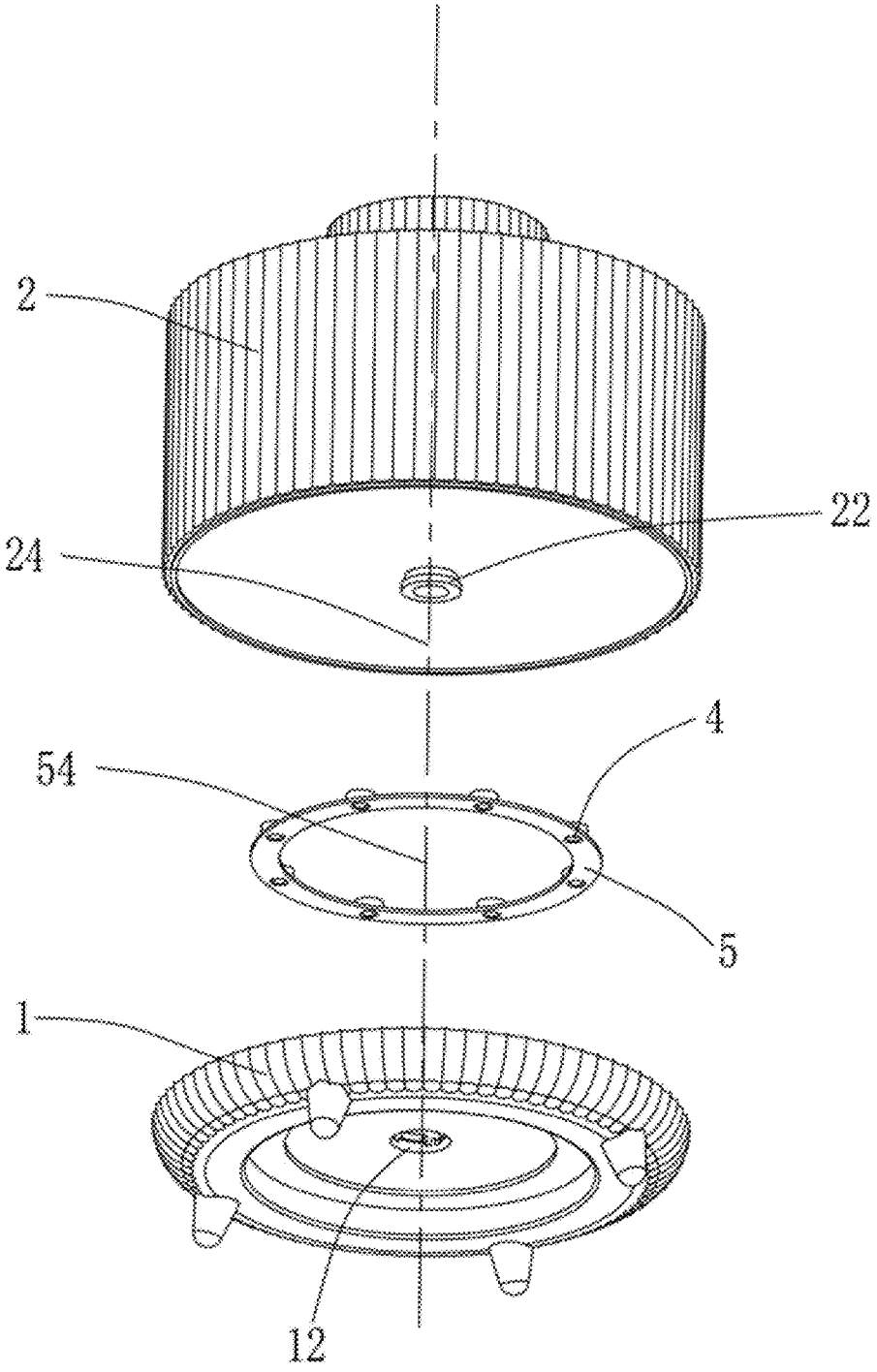
FIG. 5 is a schematic exploded diagram of FIG. 2, where a pen holder frame and a resistance reducing device are exploded.
Figure 6:
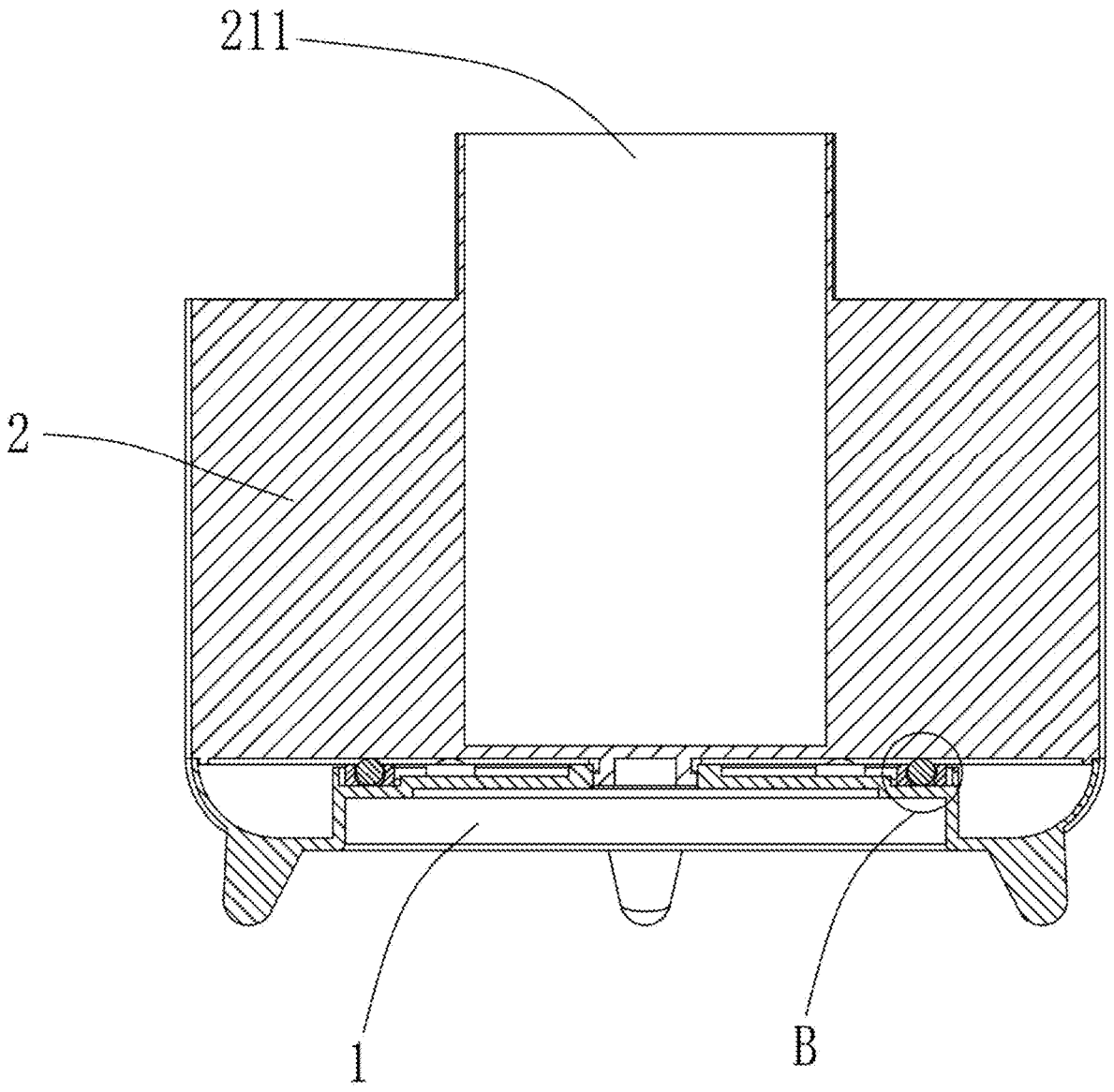
FIG. 6 is a cross-sectional view cut away along balls according to the present disclosure.
Figure 7:
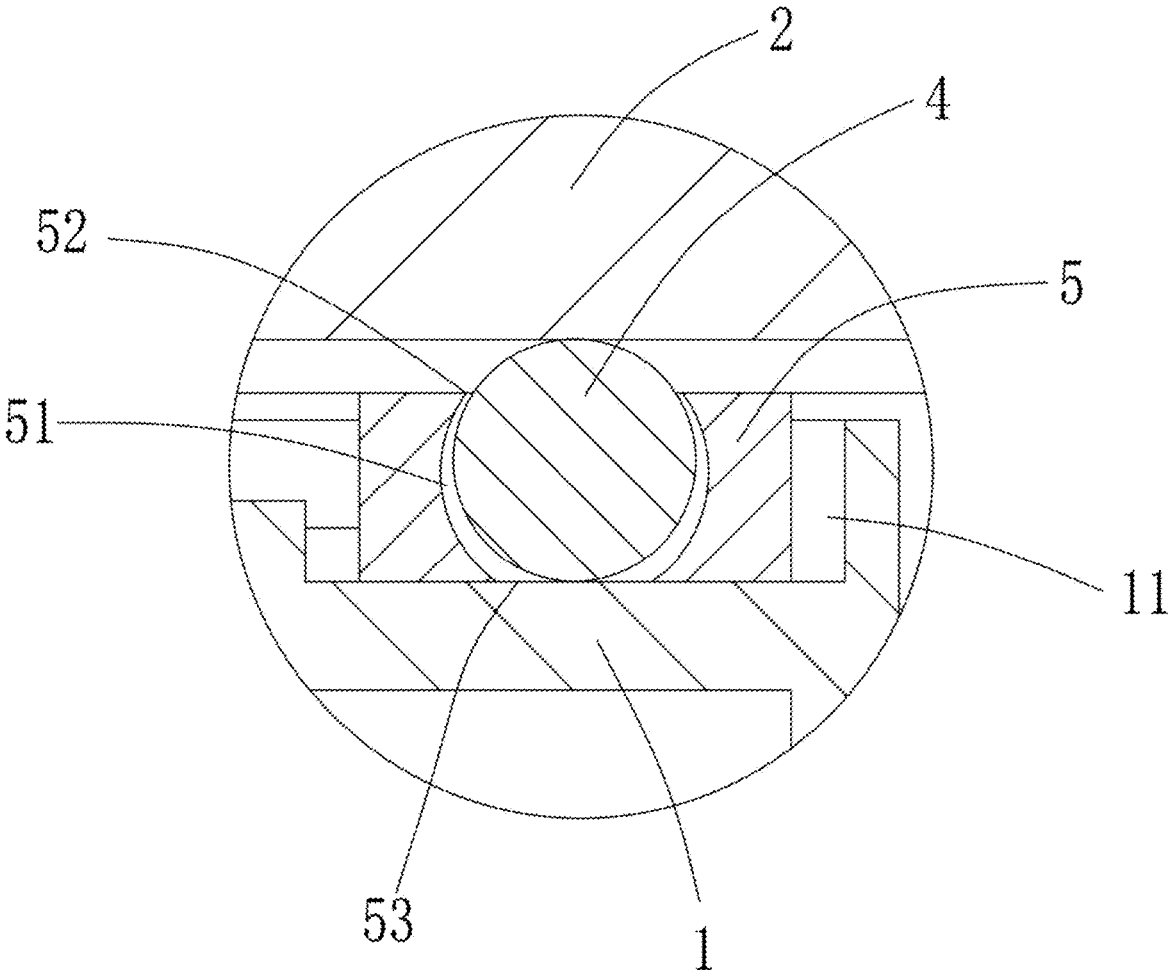
FIG. 7 is an enlarged view of the part B in FIG. 6.
Figure 8:
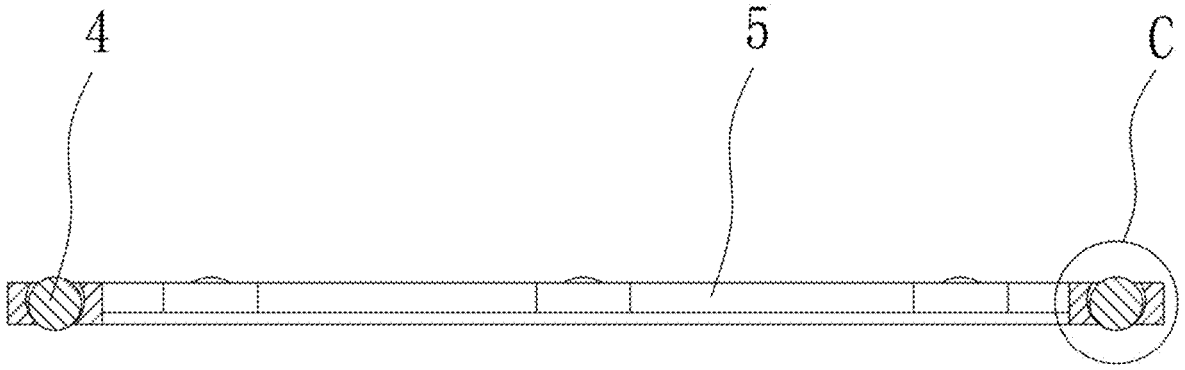
FIG. 8 is a cross-sectional view of a resistance reducing device.
Figure 9:
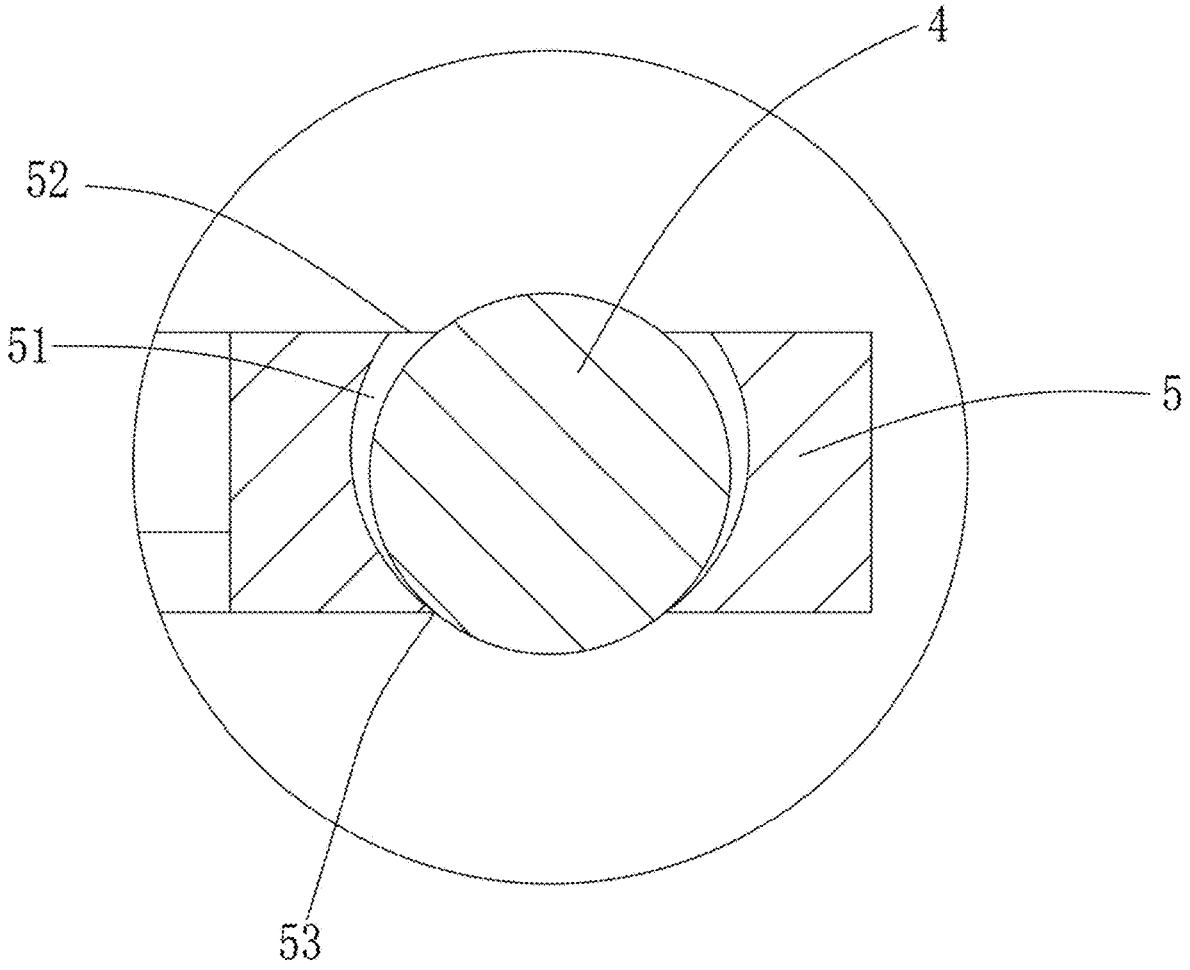
FIG. 9 is an enlarged view of the part C in FIG. 8.
Figure 10:
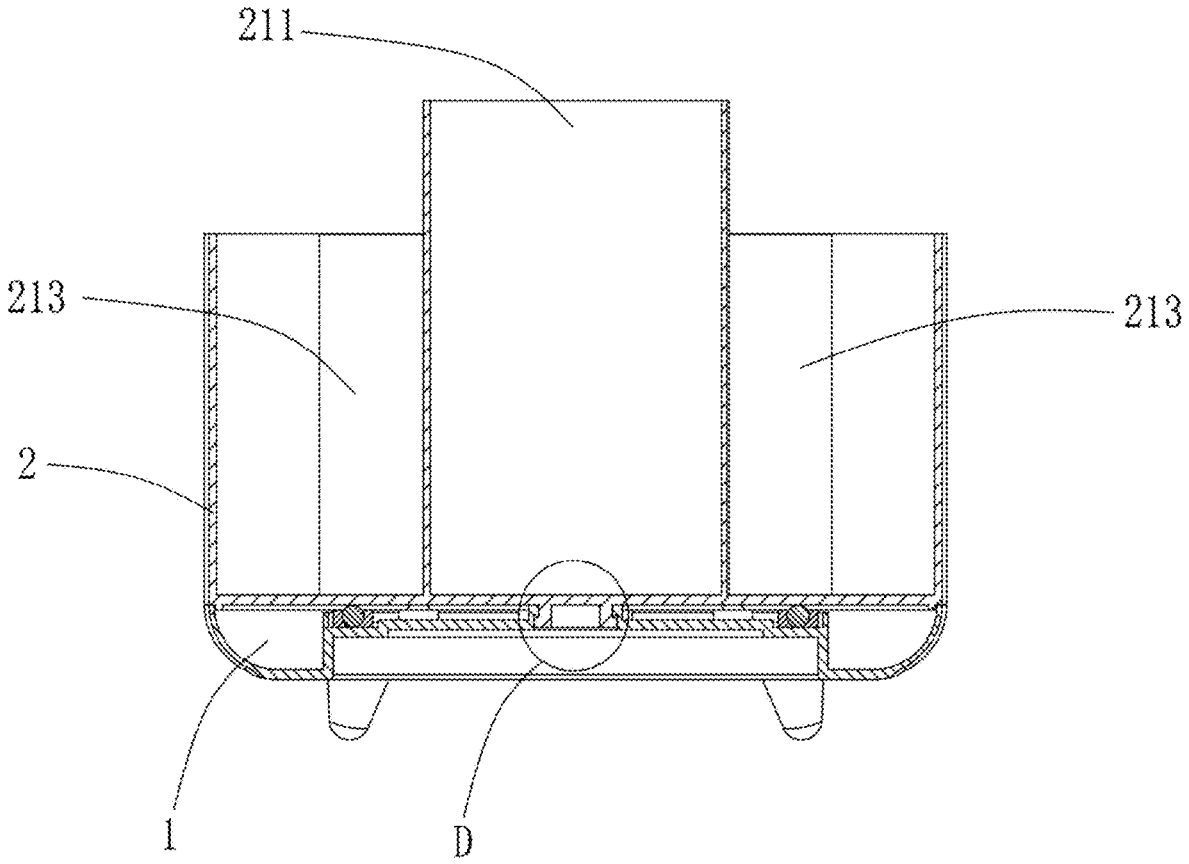
FIG. 10 is a cross-sectional view cut away along a limiting block according to the present disclosure.
Figure 11:
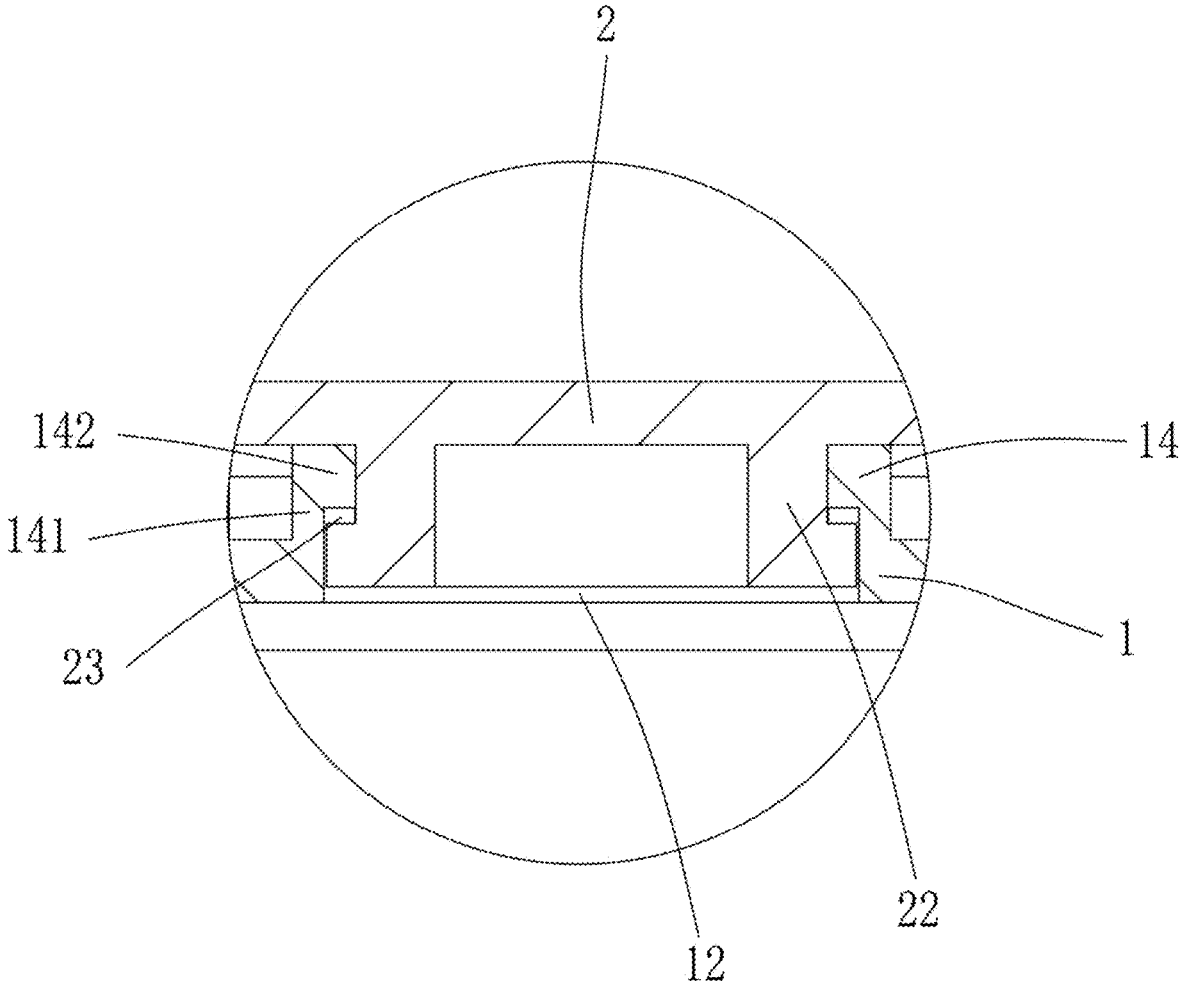
FIG. 11 is an enlarged view of the part D in FIG. 10.
Figure 12:
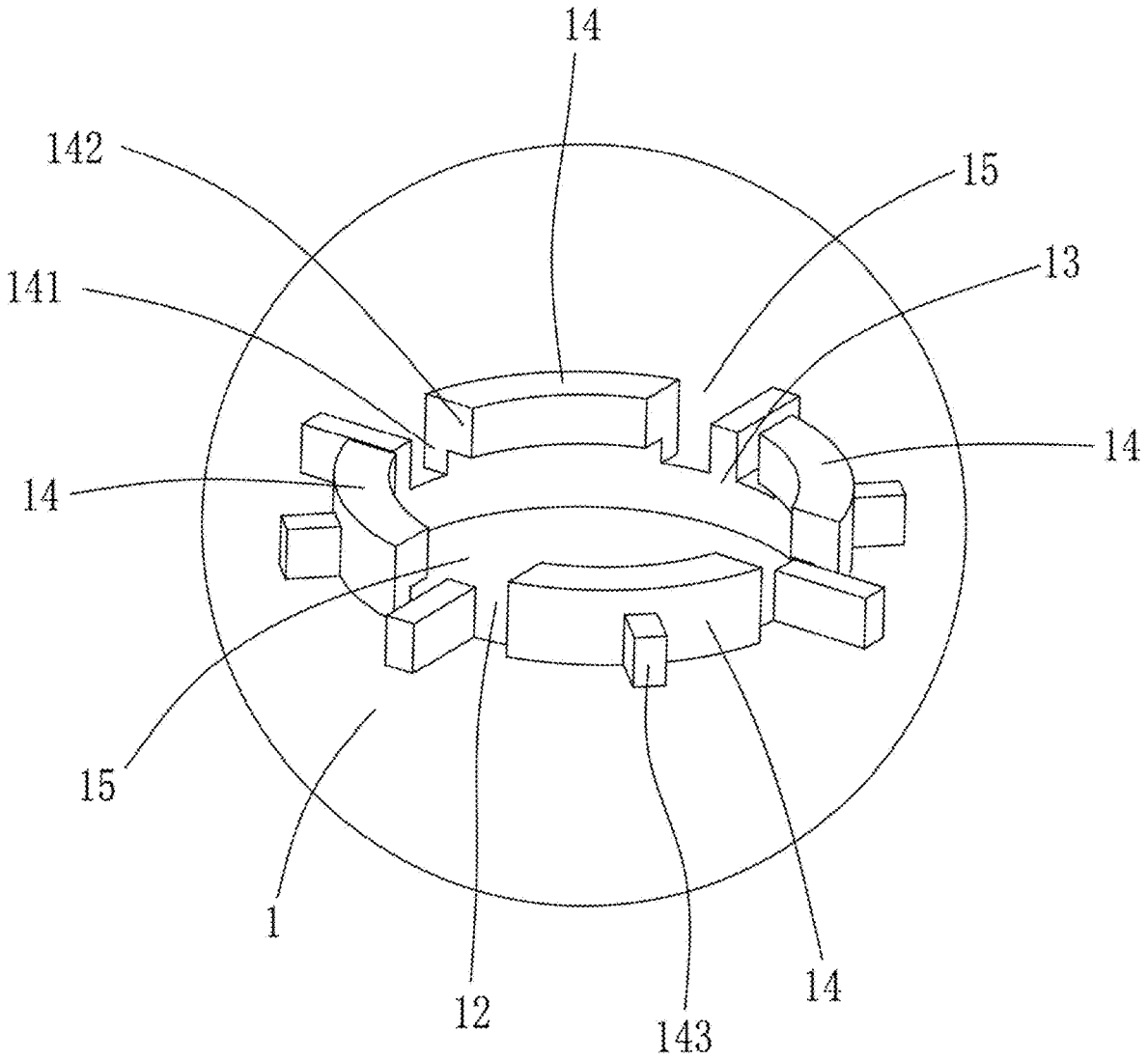
FIG. 12 is an enlarged view of the part A in FIG. 4.

Referring to FIG. 1 to FIG. 12, a novel pen holder is provided, including a pen holder base 1 and a pen holder frame 2. The pen holder base 1 is configured to place the pen holder. The pen holder frame 2 is arranged on the pen holder base 1. The pen holder frame 2 can rotate on the pen holder base 1. The pen holder frame 2 is provided with an accommodating chamber 21. The accommodating chamber 21 is configured to accommodate pens or other office supplies.

Through the above structural arrangement, during use, the pen holder can be placed on an office desk through the pen holder base, and the pens or other office supplies are placed in the accommodating chamber of the pen holder frame. The pen holder has a simple structure and is convenient to use. Since the pen holder frame can rotate on the pen holder base, when an office supply is searched for, taken out, or placed, a user can rotate the pen holder frame to make different positions in the accommodating chamber close to the user, and the user can quickly find a desired position in the accommodating chamber, which achieves convenient and efficient searching for, taking out, and placement of the office supply.

A resistance reducing device 3 (which is specifically a device for reducing friction resistance) is arranged between the pen holder frame 2 and the pen holder base 1 to reduce friction resistance during rotation of the pen holder frame 2, so that the pen holder frame rotates more smoothly on the pen holder base.

Specifically, the resistance reducing device 3 includes balls 4; the balls 4 are arranged at a top of the pen holder base 1; and the balls 4 resist against a bottom of the pen holder frame 2 to form a supporting point for the bottom of the pen holder frame 2. Through the above structural arrangement, the balls can serve as supporting point for the pen holder. Furthermore, when the pen holder rotates, the balls resist against the bottom of the pen holder frame. The pen holder frame can drive the balls to roll, thereby effectively reducing the friction resistance during the rotation of the pen holder, facilitating the rotation of the pen holder, and achieving primary resistance reducing of the resistance reducing device.

Further, the resistance reducing device 3 further includes a bracket 5. The bracket 5 is arranged at the top of the pen holder base 1. The balls 4 are arranged on the bracket 5.

Further, a ball chamber 51 is arranged on the bracket 5. A width dimension of the ball chamber 51 is slightly greater than a diameter of each ball 4, so that the ball can roll in the ball chamber. A height dimension of the ball chamber 51 is slightly less than the diameter of the ball 4. Furthermore, the ball chamber 51 has a top opening 52, so that the ball in the ball chamber can protrude outwards via the top opening. Thus, when the ball 4 is arranged in the ball chamber 51, the ball 4 resists against the bottom of the pen holder frame 2 through the top opening 52.

Further, a width dimension of the top opening 52 is slightly less than the diameter of the ball 4 to limit the ball 4 in the ball chamber 51, so as to prevent the ball from leaving the ball chamber via the top opening. The structure is simple and reliable. The top opening may be a round opening, a diameter of which is slightly less than the diameter of the ball.

Further, a bracket groove 11 is provided at the top of the pen holder base 1; the bracket 5 is arranged in the bracket groove 11; and a height of a side wall of the bracket groove 11 is less than the diameter of the ball 4, so that the ball 4 protrudes out of the bracket groove 11 and resists against the bottom of the pen holder frame 2. The structural design is proper and ingenious.

Further, the bracket 5 is arranged in a circular ring shape. Correspondingly, the bracket groove 11 is arranged in a circular ring shape too. Since the bracket is arranged in the bracket groove, the bracket groove can be formed as a guide rail for limiting a motion trajectory of the bracket. In addition, the ball chamber 51 is provided with a bottom opening 53. The ball 4 resists against the bottom wall of the bracket groove 11 through the bottom opening 53, so that the ball can be formed as a supporting point for the rotation of the bracket, and the bracket 5 can rotate in the bracket groove 11, thereby achieving secondary resistance reduction of the resistance reducing device.

Further, a width dimension of the bottom opening 53 is slightly less than the diameter of the ball 4 to limit the ball 4 in the ball chamber 51, so as to prevent the ball from leaving the ball chamber via the bottom opening. The structure is simple and reliable. The bottom opening may be a round opening, a diameter of which is slightly less than the diameter of the ball.

Further, referring to FIG. 6 to FIG. 9, the ball chamber 51 is a spherical inner chamber, and a diameter of the ball chamber 51 is slightly greater than the diameter of the ball 4. In this way, the overall structure of the ball chamber has a narrow top (the top opening with the diameter slightly less than that of the ball), a wide middle part (the spherical inner chamber with the diameter slightly greater than that of the ball), and a narrow bottom (the bottom opening with the diameter slightly less than that of the ball). Since the diameter of the ball chamber is slightly greater than that of the ball, when the ball is located in the ball chamber, there is always a gap space between the ball and an inner wall of the ball chamber in a three-dimensional direction, ensuring that the ball can roll freely and smoothly. Moreover, since the height of the bracket is slightly smaller than the diameter of the ball, a distance between the top opening and the bottom opening is slightly less than the diameter of the ball. Therefore, the height of the ball chamber is slightly less than the diameter of the ball, ensuring that the ball can always resist against the bottom of the pen holder frame via the top opening and resist against the bottom wall of the bracket groove via the bottom opening. The design is proper and ingenious. In addition, when the bracket is placed in the bracket groove, the bottom of the ball is flush with the bottom opening of the ball chamber, so that the bottom of the ball and the bottom of the bracket both resist against the bottom wall of the bracket groove. Furthermore, when the bracket is not placed in the bracket groove, the bottom of the ball can fall into the bottom opening of the ball chamber and protrude outwards via the bottom opening.

Furthermore, the bracket can be a plastic bracket. The diameters of both the top opening and the bottom opening are slightly less than the diameter of the ball. During assembling, the ball is placed in the top opening or the bottom opening and is pressed into the ball chamber. The structure is simple and is convenient to assemble.

Further, a circumferential center 54 of the bracket 5 is coaxial with a rotation center 24 of the pen holder frame 2; at least three ball chambers 51 are arranged in a circumferential direction of the bracket 5; and the balls 4 are arranged in the at least three of the ball chambers 51.

Through the above structural arrangement, at least three balls are distributed in the circumferential direction of the bracket. Namely, the at least three balls resist against the bottom of the pen holder frame, and the at least three balls resist against the bottom wall of the bracket groove. During use, the rotation of the pen holder frame will drive the balls to roll in the ball chambers. The balls can further drive the bracket to rotate in the bracket grooves. Moreover, the pen holder frame and the bracket rotate coaxially, so that the pen holder frame rotates on the pen holder base more smoothly.

Further, eight ball chambers 51 are provided; and the eight ball chambers 51 are uniformly distributed in the circumferential direction of the bracket 5, so that the resistance reducing effect is better.

A rotating shaft 22 is arranged at a position, provided with the rotation center 24, at the bottom of the pen holder frame 2. Correspondingly, a center hole 12 is provided at the top of the pen holder base 1. The rotating shaft 22 is arranged in the center hole 12, so that the pen holder frame 2 can rotate on the pen holder base 1. The structure is simple and is convenient to assemble.

Further, a limiting slot 23 is provided on an outer wall of the rotating shaft 22 in the circumferential direction of the rotating shaft 22; a limiting block 14 is arranged at a top port 13 of the center hole 12; and when the rotating shaft 22 is arranged in the center hole 12, the limiting block 14 is arranged in the limiting slot 23. Through the above structural arrangement, the cooperation between the limiting block and the limiting slot is mainly to prevent the rotating shaft from being separated from the center hole, namely, to prevent the pen holder frame from being separated from the pen holder base. In this structure, the limiting block will not fix the rotating shaft relative to the center hole.

Further, at least two limiting blocks 14 are arranged around the top port 13 of the center hole 12; and a gap 15 is provided between every two adjacent limiting blocks 14 to achieve intermittent arrangement between every two adjacent limiting blocks 14. Specifically, each limiting block may include a vertically arranged supporting portion 141 and a horizontally arranged insertion portion 142. The arrangement of the supporting portion allows the limiting block to undergo an elastic deformation, so that when the rotating shaft is assembled with or disassembled from the center hole, the insertion portion can be quickly placed into the limiting slot, or the insertion portion can be quickly separated from the limiting slot. Furthermore, the supporting portion is further provided with a reinforcing rib 143 to prevent the supporting portion from being broken. Specifically, four limiting blocks 14 are provided.

The accommodating chamber 21 includes a center chamber 211 arranged in a center and a surrounding chamber 212 arranged around the center chamber 211. Furthermore, the surrounding chamber 212 is uniformly divided into four surrounding sub-chambers 213 along the circumferential direction.

Further, a side wall of the center chamber 211 is higher than a side wall of the surrounding chamber 212. During use, a ruler and scissors can be placed in the center chamber with a higher side wall, and a pen and other office supplies are placed in the surrounding chamber. The pen can be a pencil, a ballpoint pen, a signature pen, a fountain pen, a marker pen, and the like. Other office supplies may be paper clips, erasers, and the like. Moreover, the surrounding chamber is composed of four surrounding sub-chambers which can be classified for different types of office supplies. For example, the center chamber can accommodate the ruler, the scissors, and other office supplies, and the various surrounding sub-chambers can classify and accommodate different types of office supplies. The signature pen and the ballpoint pen belong to the same type; the paper clips and clips belong to the same type; and the eraser and the pencil belong to the same type, to facilitate searching for, taking out, and placement of different types of office supplies. Specific classification modes will not be listed here.

Figure 13:
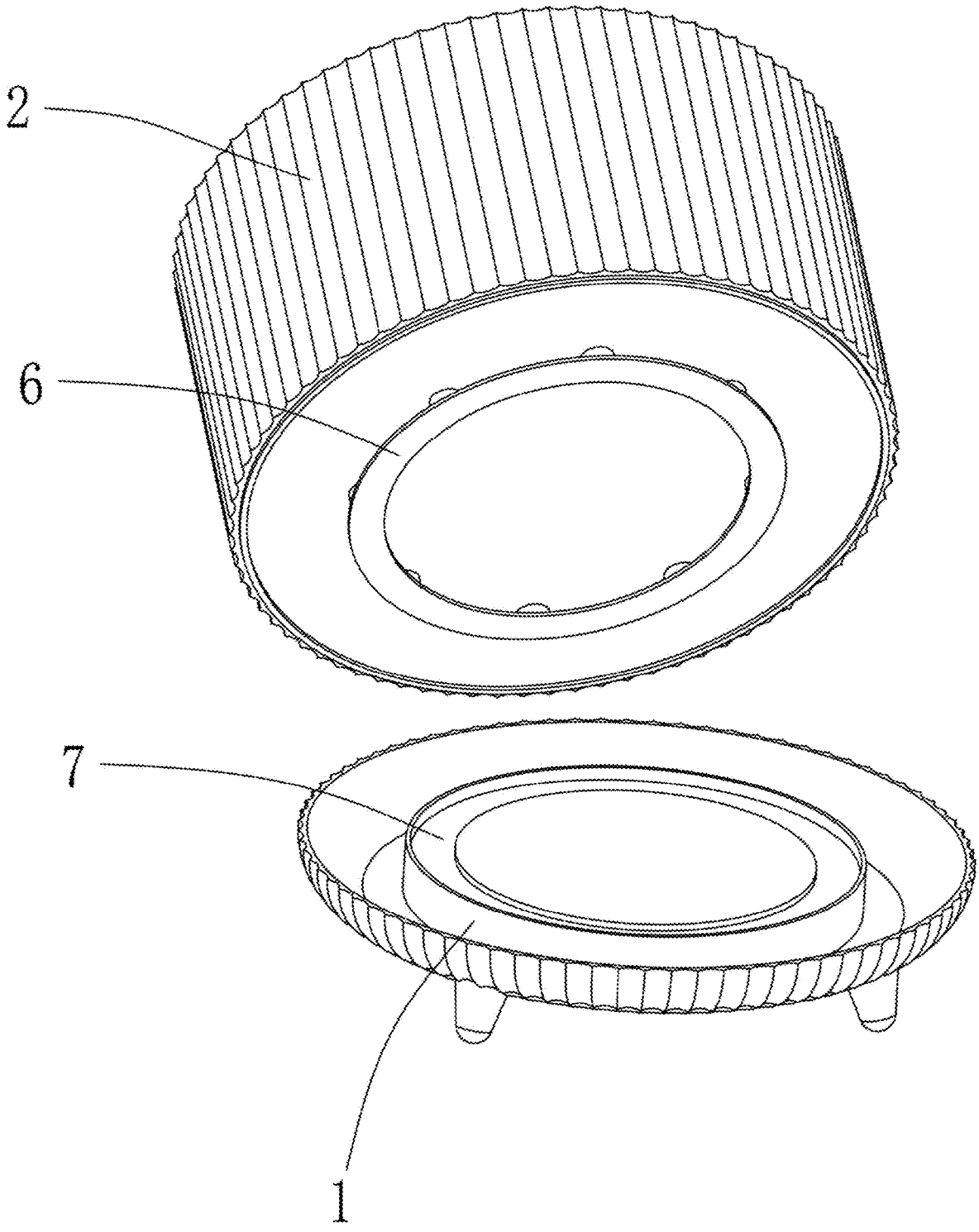
FIG. 13 is a schematic exploded diagram of the present disclosure, showing a rotation bracket and a guide rail in a first alternative configuration.

Referring to FIG. 13, in this patent, there may be various specific structural ways for the pen holder frame to rotate on the pen holder base. In addition to the above structure where the rotating shaft of the pen holder frame is adapted to the center hole of the pen holder base, there may be also a structure where a rotation bracket is adapted to a guide rail.

Figure 14:
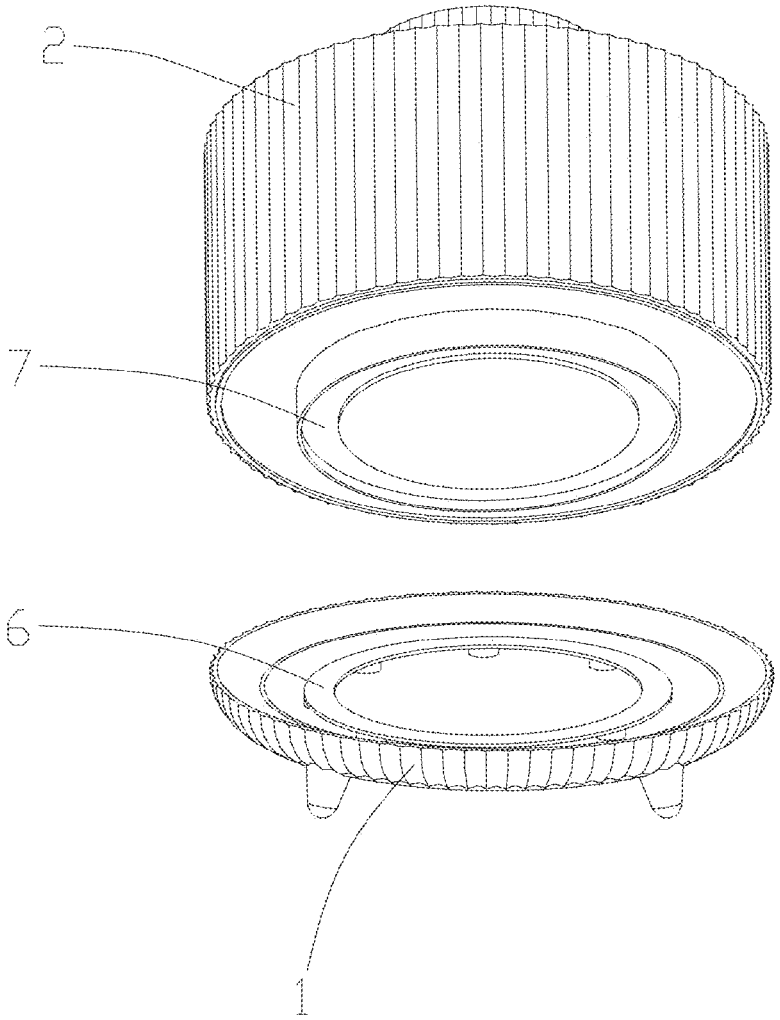
FIG. 14 is a schematic exploded diagram of the present disclosure, showing the rotation bracket and the guide rail in a second alternative configuration.

Specifically, referring to FIG. 14, the novel pen holder further includes a circular-ring-shaped rotating bracket 6 and a circular-ring-shaped guide rail 7, the rotation bracket 6 is arranged at a top of the pen holder base 1, and correspondingly, the guide rail 7 is arranged at the bottom of the pen holder frame 2; the rotation bracket 6 is arranged into the guide rail 7; and the rotation bracket 6 can rotate in the guide rail 7, so that the pen holder frame can rotate on the pen holder base.

Alternatively, the novel pen holder further includes a circular-ring-shaped rotating bracket 6 and a circular-ring-shaped guide rail 7; the rotation bracket 6 is arranged at a bottom of the pen holder frame 2, and correspondingly, the guide rail 7 is arranged at the top of the pen holder base 1; the rotation bracket 6 is arranged into the guide rail 7; and the rotation bracket 6 can rotate in the guide rail 7, so that the pen holder frame 2 can rotate on the pen holder base 1.

In both the above structures, the pen holder frame can rotate on the pen holder base through the cooperation between the rotation bracket and the guide rail, with a simple and stable structure.

The above shows one or more implementations provided in combination with specific contents, and it is not deemed that the specific implementations of the present disclosure is limited to these explanations. Any technical inferences or replacements that are similar or identical to the method and structure of the present disclosure or made under the idea of the present disclosure shall fall within the protection scope of the present disclosure.

What is claimed is:

1. A novel pen holder, comprising a pen holder base (1) and a pen holder frame (2), wherein the pen holder base (1) is configured to place the pen holder; the pen holder frame (2) is arranged on the pen holder base (1); the pen holder frame (2) rotates on the pen holder base (1); the pen holder frame (2) is provided with an accommodating chamber (21); and the accommodating chamber (21) is configured to accommodate pens or other office supplies;

wherein a resistance reducing device (3) is arranged between the pen holder frame (2) and the pen holder base (1) to reduce friction resistance during rotation of the pen holder frame (2);

the resistance reducing device (3) further comprises a bracket (5) and balls (4); the bracket (5) is arranged at the top of the pen holder base (1); and the balls (4) are arranged on the bracket (5);

wherein a bracket groove (11) is e provided at the top of the pen holder base (1); the bracket (5) is arranged in the bracket groove (11); and a height of a side wall of the bracket groove (11) is less than a diameter of each of the balls (4), so that the balls (4) protrude out of the bracket groove (11) and resist against the bottom of the pen holder frame (2).

2. The novel pen holder according to claim 1, wherein ball chambers (51) are arranged on the bracket(5); a width dimension of each of the ball chambers (51) is slightly greater than a diameter of each of the balls (4); a height dimension of each of the ball chambers (51) is slightly less than the diameter of each of the balls (4); each of the ball chambers (51) has a top opening (52); and when the balls (4) are respectively arranged in the ball chambers (51), each of the balls (4) resists against the bottom of the pen holder frame (2) through each top opening (52).

3. The novel pen holder according to claim 2, wherein a width dimension of each top opening (52) is slightly less than the diameter of each of the balls (4) to limit each of the balls (4) in a corresponding one of the ball chambers (51).

4. The novel pen holder according to claim 1, wherein the bracket (5) is arranged in a circular ring shape; correspondingly, the bracket groove (11) is arranged in a circular ring shape too; each of the ball chambers (51) is provided with a bottom opening (53); and each of the balls (4) resists against a bottom wall of the bracket groove (11) via each bottom opening (53), so that the bracket (5) rotates in the bracket groove (11).

5. The novel pen holder according to claim 4, wherein a width dimension of each bottom opening (53) is slightly less than the diameter of each of the balls (4) to limit the balls (4) in the ball chambers (51).

6. The novel pen holder according to claim 5, wherein each of the ball chamber (51) is a spherical inner chamber, and a diameter of each of the ball chambers (51) is slightly greater than the diameter of each of the balls (4).

7. The novel pen holder according to claim 4, wherein a circumferential center (54) of the bracket (5) is coaxial with a rotation center (21) of the pen holder frame (2); at least three ball chambers (51) are arranged in a circumferential direction of the bracket (5); and the balls (4) are respectively arranged in the at least three ball chambers (51).

8. The novel pen holder according to claim 7, wherein eight ball chambers (51) are provided; and the eight ball chambers (51) are uniformly distributed in the circumferential direction of the bracket (5).

9. The novel pen holder according to claim 7, wherein a rotating shaft (22) is arranged at a position, provided with the rotation center (21), at the bottom of the pen holder frame (2); correspondingly, a center hole (12) is provided at the top of the pen holder base (1); and the rotating shaft (22) is arranged in the center hole (12), so that the pen holder frame (2) rotates on the pen holder base (1).

10. The novel pen holder according to claim 9, wherein at least one limiting slot (23) is provided on an outer wall of the rotating shaft (22) in the circumferential direction of the rotating shaft (22); at least one limiting block (14) is arranged at a top port (13) of the center hole (12); and when the rotating shaft (22) is arranged in the center hole (12), the at least one limiting block (14) is arranged in the at least one limiting slot (23).

11. The novel pen holder according to claim 10, wherein the at least one limiting block (14) comprises at least two limiting blocks (14) arranged around the top port (13) of the center hole (12); and a gap (15) is provided between every two adjacent limiting blocks (14) to achieve intermittent rangement between every two adjacent limiting blocks (14).

12. The novel pen holder according to claim 9, wherein four limiting blocks (14) are provided.

13. The novel pen holder according to claim 1, wherein the accommodating chamber (21) comprises a center chamber (211) arranged in a center and a surrounding chamber (212) arranged around the center chamber (211).

14. The novel pen holder according to claim 13, wherein the surrounding chamber (212) is uniformly divided into four surrounding sub-chambers (213) along the circumferential direction.

15. The novel pen holder according to claim 13, wherein a side wall of the center chamber (211) is higher than a side wall of the surrounding chamber (212).

16. A novel pen holder, comprising a pen holder base (1) and a pen holder frame (2), wherein the pen holder base (1) is configured to place the pen holder; the pen holder frame (2) is arranged on the pen holder base (1); the pen holder frame (2) rotates on the pen holder base (1); the pen holder frame (2) is provided with an accommodating chamber (21); the accommodating chamber (21) is configured to accommodate pens or other office supplies;

the novel pen holder further comprises a circular-ring-shaped rotating bracket (6) and a circular-ring-shaped guide rail (7); the rotation bracket (6) is arranged at a top of the pen holder base (1) or a bottom of the pen holder frame (2); correspondingly, the guide rail (7) is arranged at the bottom of the pen holder frame (2) or the top of the pen holder base (1); the rotation bracket (6) is arranged into the guide rail (7); and the rotation bracket (6) rotates in the guide rail (7), so that the pen holder frame (2) rotates on the pen holder base (1).

* * * * *